US005927211A

United States Patent [19]

Giasi

[11] Patent Number: 5,927,211

[45] Date of Patent: Jul. 27, 1999

[54] SANITIZED CARDBOARD PALLET

[76] Inventor: Joseph P. Giasi, 20 W. Park Ave., Long Beach, N.Y. 11561

[21] Appl. No.: 09/109,400

[22] Filed: Jul. 2, 1998

[51] Int. Cl.[6] ..... B65D 19/00

[52] U.S. Cl. ..... 108/51.3; 108/56.3

[58] Field of Search ..... 108/51.3, 56.3, 108/56.1

[56] References Cited

U.S. PATENT DOCUMENTS

| | | | |
|---|---|---|---|
| 5,269,219 | 12/1993 | Juvik-Woods | 108/56.3 X |
| 5,441,154 | 8/1995 | Youell, III | 108/51.3 X |
| 5,473,995 | 12/1995 | Gottlieb | 108/51.3 |
| 5,567,263 | 10/1996 | Giasi | 108/51.3 X |
| 5,664,394 | 9/1997 | Sweeney | 108/56.3 X |

*Primary Examiner*—Peter M. Cuomo
*Assistant Examiner*—Karlenia D. Schwing
*Attorney, Agent, or Firm*—Myron Amer PC

[57] ABSTRACT

A method of separately manufacturing a pallet platform and plural legs, both of cardboard construction material, at a manufacturing site contemplating assembly at a user's site, so that shipment therebetween is significantly enhanced by size reduction and ease of handling, wherein assembly at the site of use is in accordance with adhesive technology using cooperating adhesives which adhere only to each other so that these adhesives are also advantageously applied at the manufacturing site and do not detract from the facilitated shipment of the pallet components as might occur if inadvertent contact was made by these adhesives to surfaces other than each other. Additionally, all access openings into the interior of the pallet are sealed, and the use of kraft paper for its exterior obviate insect infestation of the pallet.

1 Claim, 3 Drawing Sheets

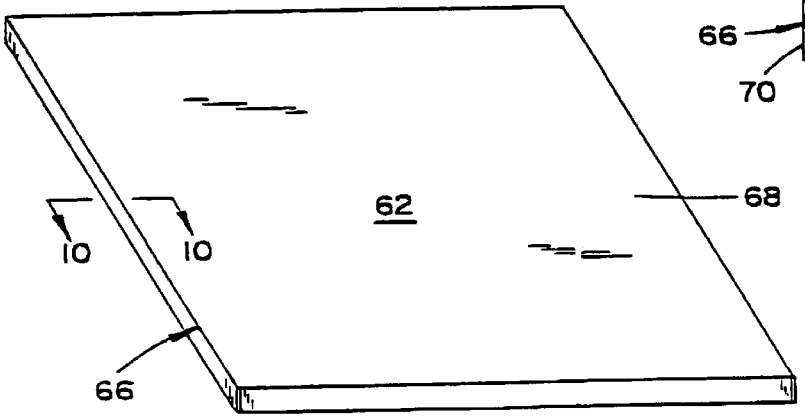
FIG. 9
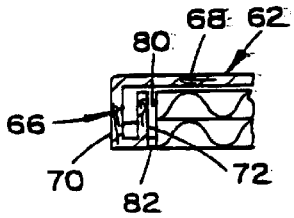
FIG. 10
FIG. 8
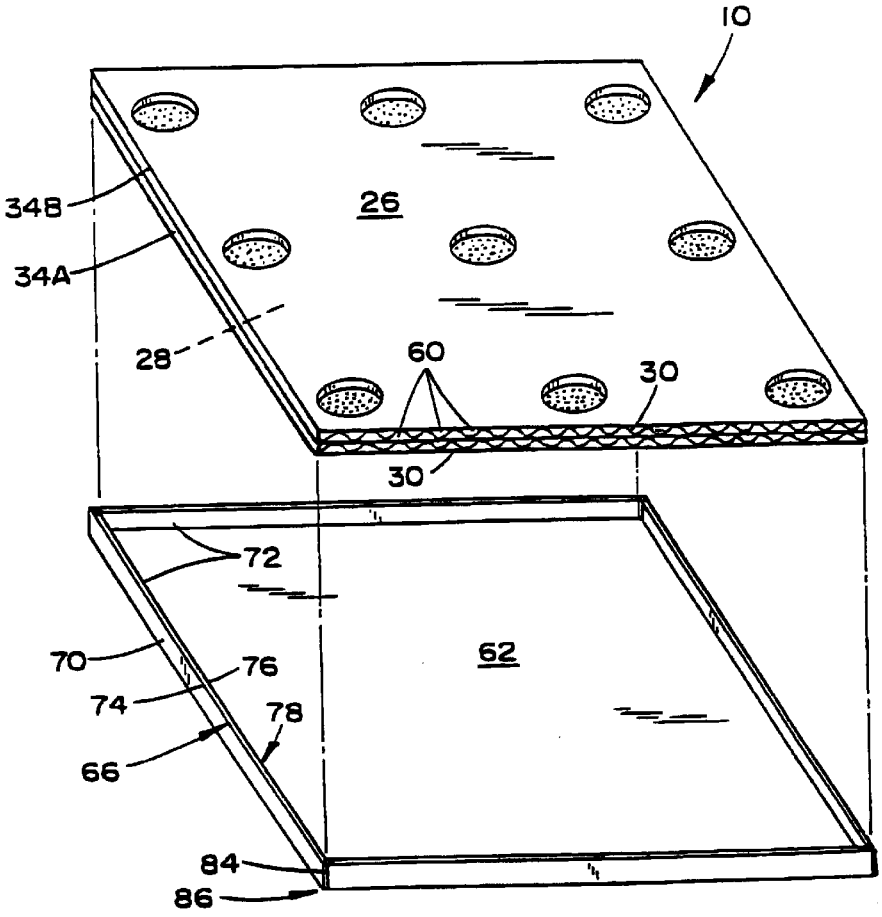

SANITIZED CARDBOARD PALLET

The present invention relates to improvements for a cardboard pallet, and more particularly to the construction improvements thereof which facilitate its embodiment at a site of manufacture preliminarily as a work-in-process component preparatory to shipment to a site of use where it is readily assembled into a completed article-of-manufacture, thereby contributing to significant savings in shipping, storage and handling expense.

In providing such a pallet construction system, the current use of wood is dispensed with, and instead use is made of cardboard construction material. An attendant benefit of this substitution of construction materials is the facilitated manner in which the cardboard construction material is sanitized against insect infestation, all as will be better understood as the description proceeds.

EXAMPLE OF THE PRIOR ART

U.S. Pat. No. 5,176,090 for "Recyclable Paper Pallet" issued to Mark Roberts et al. on Jan. 5, 1993 describes and illustrates a paper pallet which can be shipped and stored as two die cut and scored cardboard pieces for which the benefit claimed is eliminating excess volume. Presumably this savings in volume occurs during shipment from a manufacturing site of the cardboard pieces to a site where the cardboard pieces, after assembly into a pallet, are used for supporting weight loads and in other typical ways. At the site of use, however, the assembly contemplates use of plural interconnecting tabs and slots, which is time consuming and tedious thereby contributing to a standoff of an added complication at the user's site offsetting the benefit gained at the manufacturing site.

Broadly, it is an object of the present invention to provide an unassembled pallet for the shipping benefit this provides, which is also readily assembled at the use site thereby overcoming the foregoing and other shortcomings of the prior art.

More particularly, the pallet components which, to eliminate "excess volume" are shipped in unassembled condition, are assembled adhesively rather than by mechanical interlocking, but with optimum minimum implementation of the adhesive function at the user's site. That is, the major preparation for the adhesive function at the user's site is attended to at the manufacturer's site, and yet the unassembled adhesively-prepared pallet components present no problem during separate shipment and are readily assembled preparatory to use as a completed pallet.

The aforesaid is achieved, as will be better understood as the description proceeds, using to advantage adhesive technology provided by cooperating adhesives which attach only to each other and not otherwise to surfaces as might inadvertently be contacted during separate shipment of the unassembled pallet components.

Another object is to sanitize the constructed pallet against insect infestation which, according to the present invention, is achieved using to advantage the kraft paper construction material since, underlying this aspect of the invention is the recognition that kraft paper is manufactured so as to embody the same chemicals as a fumigating preparation, thus resisting insect penetration into the interior of the constructed pallet.

The description of the invention which follows, together with the accompanying drawings should not be construed as limiting the invention to the example shown and described, because those skilled in the art to which this invention appertains will be able to devise other forms thereof within the ambit of the appended claims.

FIG. 8 is an exploded perspective view of a pallet and a cooperating cover to obviate insect infestation;

FIG. 9 is a perspective view of the assembly of said pallet and cover; and

FIG. 10 is a partial cross sectional view as taken along line 10—10 of FIG. 9.

PALLET CONSTRUCTION SYSTEM

Figure 5:
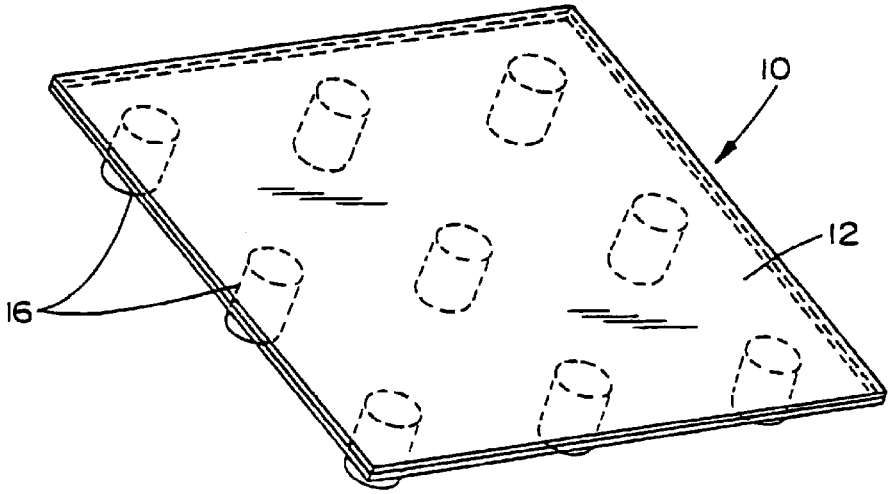
FIG. 5 is a perspective view of the pallet as a completed article-of-manufacture.
Figure 6:
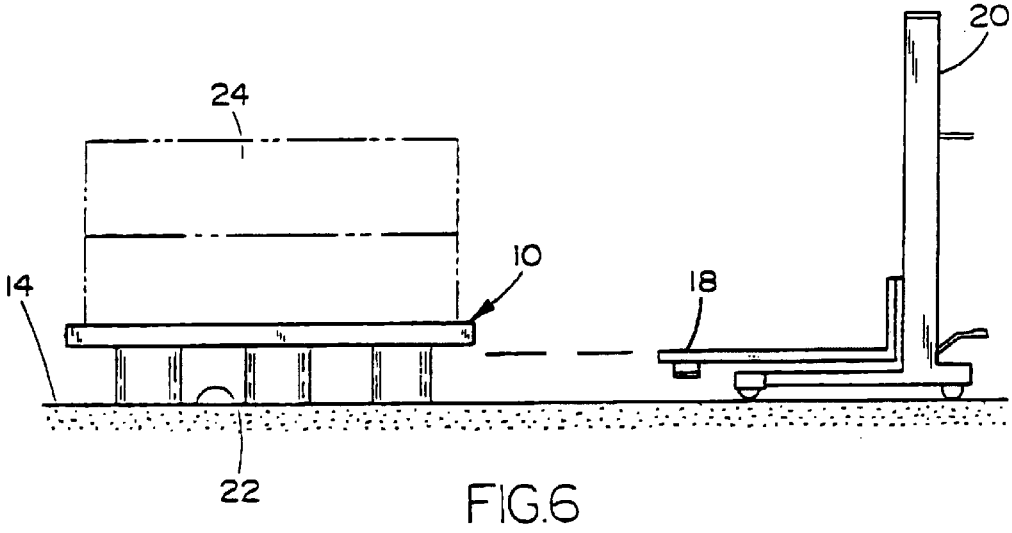
FIG. 6 is a side elevational view illustrating typical use of the pallet.
Figure 7A:
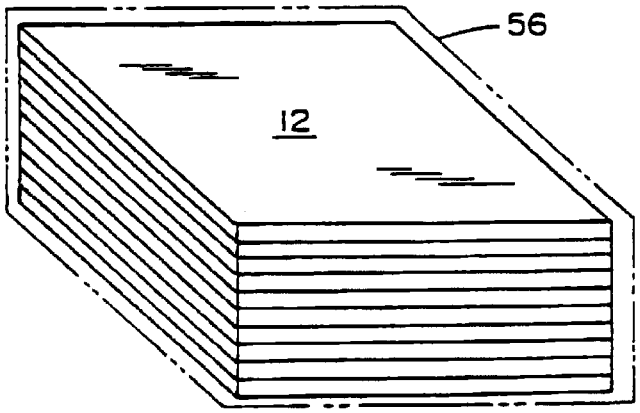
FIGS. 7A and 7B are perspective views illustrating the unassembled platform and leg components as prepared at a manufacturer's site for shipment to a site of use as depicted in FIG. 6.
Figure 7B:
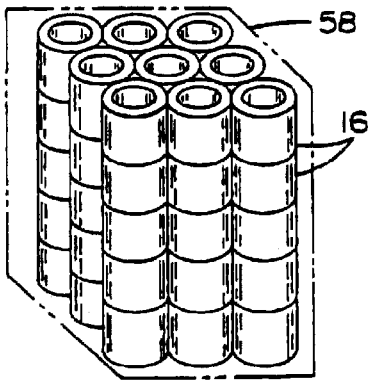

The within inventive pallet, as illustrated in FIG. 5 and denoted by the reference number 10, as a completed article-of-manufacturer at a site of use has, for the weight-supporting purposes intended, a platform 12 supported in a clearance position above a factory floor 14 or the like (FIG. 6) on plural legs, individually and collectively designated 16, so that, as depicted in FIG. 6, tines 18 of a fork lift truck 20 can be projected in the clearance 22 beneath the platform to lift and transport weight loads 24 in position on the pallet 10.

Figure 1:
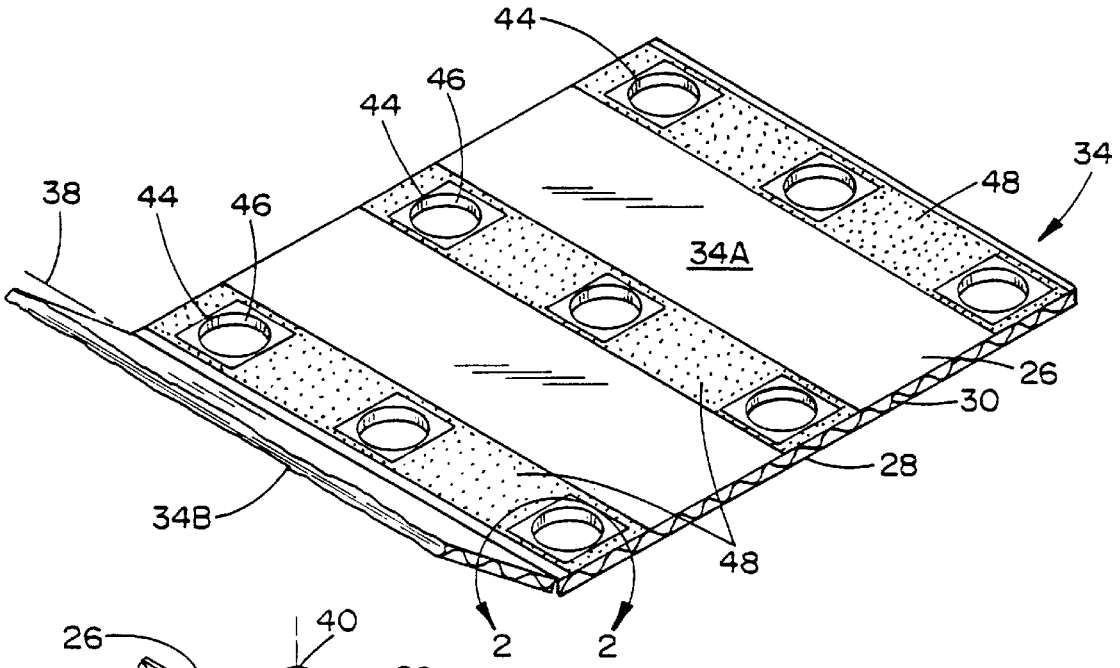
FIG. 1 is a partial perspective view of a work-in-process weight-supporting platform of a cardboard pallet according to the present invention.
Figure 2:
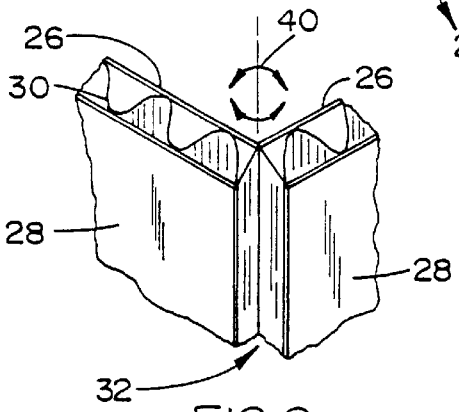
FIG. 2 is a detail perspective view on an enlarged scale and, as taken along lines 2—2 of FIG. 1, of a hinge of the pallet component of FIG. 1.

Some unique aspects of the pallet 10, among others, reside in the cardboard construction material of the pallet 10 consisting, as best shown in FIGS. 1 and 2, of opposite paper plies 26 and 28 adhesively secured to an intermediate undulating flute 30 and using this construction material to fullest advantage, the making of a hinge 32 by cutting in a medial location in a work-in-process blank 34 (FIG. 1) to a selected depth through the one paper ply 28, the undulated flute 30 and leaving intact the other paper ply 26 so that, as should be readily appreciated from FIGS. 1 and 2, the two halves designated 34A and 34B delineated by the medial cut 38 can be urged through pivotal traverses 40 about the uncut paper ply 26.

Figure 4:
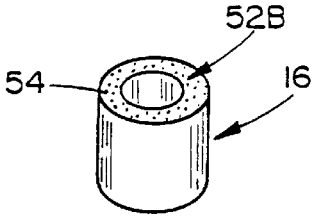
FIG. 4 is an isolated view of the leg component of the within inventive pallet.
Figure 3:
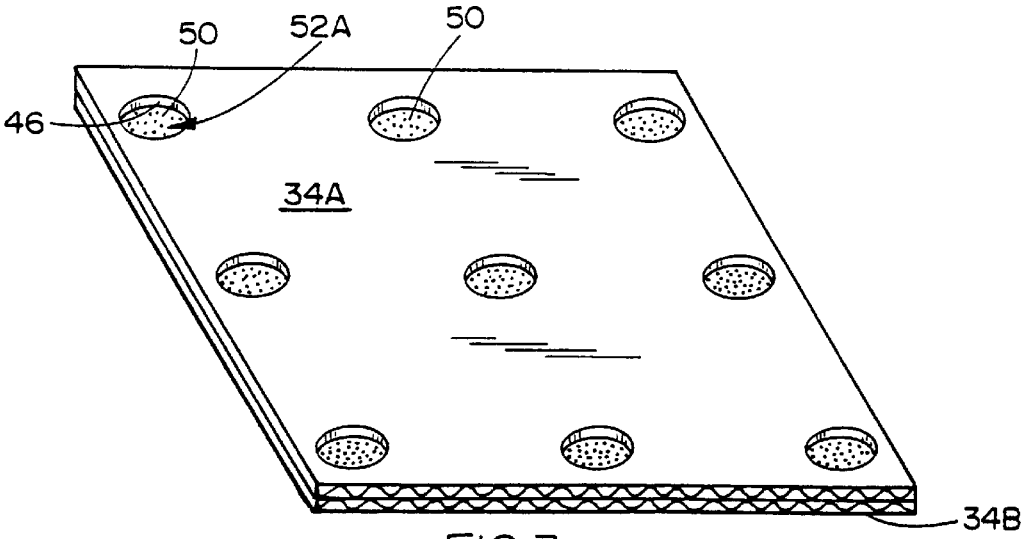
FIG. 3 is a perspective view of the pallet component of FIG. 1 at a subsequent condition of construction.

The blank 34, as removed at a manufacturer's site from a cardboard substrate is in a selected sized rectangular shape that is twice the size of the completed pallet 10 of FIG. 5, so that following a pivotal traverse about the hinge 32 the pallet half 34A is in superposed relation upon the pallet half 34B forming the work-in-process two ply assembly 42 of FIG. 3. However, prior to this assembly step, pallet half 34A is die-cut with three rows 44 each of openings 46 sized to have seated therein cardboard cores, as shown in isolated perspective in FIG. 4, which are cut to the length shown in FIG. 4 to effectively serve as the noted pallet legs 16. The cores which are cut to pallet leg length are the center supports of paper rolls which nominally are discarded.

Another preliminary preparation step consists of applying a first adhesive as a coating 48 in the three locations co-extensive with the rows 44 which adhesively secure the pallet halves 34A and 34B to each other to provide the work-in-process construction at the pallet manufacturer's site which is depicted in FIG. 3.

A final preparation step before shipment to a user's site consists of flipping the pallet assembly as initially formed, as shown in FIG. 1, 180 degrees so that surfaces 50 in the pallet half 34B are exposed through the other pallet half openings 46. To the surfaces 50 there is applied a coating 52A of a second adhesive selected to have a limited adhesive function, wherein coating 52A does not provide an adhesive function except upon contact with a cooperating coating 52B, one such second adhesive being used in practice with good results is commercially available from Impact Chemical Corp. of Patterson, N.J., as identified as LTX4801.

In accordance with the present invention, coating 52B is applied to an end surface 54 of each leg 16 with the result that the applied adhesive coatings 52A and 52B do not adhere, by intention or inadvertently, to any contacting surface, but only provide an adhesive function when placed in contact with each other, as occurs when the pallet legs 16 are seated in the cooperating openings 46, an assembly step that is not practiced at the pallet manufacturer's site but only at the user's site. The important reason for this is that the within inventive method contemplates the shipment, in unassembled relation, of an appropriate selected number of work-in-process weight supporting platforms 12 in one shipping container 56, and in a separate shipping container 58 an appropriate selected number of as yet unattached plural pallet legs 16. As should be readily appreciated, the savings in space requirements using the containers 56 and 58 for the unassembled pallet components 12 and 16, as compared with shipping the same number of complete pallets 10 of FIG. 5 is significant and underlies the present invention. At the user's site, and as needed, the legs 16 are assembled to the platforms 12, merely upon establishing contact between the adhesive coatings 52A and 52B thereof, resulting in completed pallets 10 ready for typical FIG. 6 end use.

SANITIZING THE CONSTRUCTED PALLET

Underlying the patentability of this aspect of the invention is the recognition that common chemicals are embodied in fluids used for fumigating objects against insect infestation, and also in the source fluids for manufacturing kraft paper, such that the use of kraft-paper as a construction material provides the attendant benefit of rendering an object insect infestation-free. As an imported article of manufacture, sanitizing the pallet 10 by using kraft construction material as for the panel plies 26 and 28 effectively complies with a U.S. Department of Agriculture's Plant Health Inspection Service Regulation that requires fumigation of the pallet, if made of wood.

The sanitizing of pallet 10 commences when it is in the work-in-process condition illustrated in FIG. 3 consisting of the two halves 34A and 34B, and having exposed side edge undulations or flutes 30 which bound openings, individually and collectively designated 60, opening into the interior of the two pallet halves 34A and 34B. To prevent insect infestation through the openings 60, a kraft paper-constructed cover 62 is provided for the pallet 34A, 34B that in size and shape is adapted to fit over and be adhesively secured to the FIG. 3 pallet.

All four sides of the cover 62 are identically constructed and, for brevity's sake, only side 66 is described. Side 66 depends from the cover main panel 68 and has an outer panel 70 and an inner panel 72 which are folded in facing relation to each about parallel fold lines 74 and 76, thereby providing a closed edge 78 without any entry into the interior of the pallet. The two panels 70 and 72 in covering relation over the pallet 10 assume a position closing off the openings 60 to any infestation.

Due to fitting clearance, as at 80, as might be necessary to position the cover 62 in covering relation over the FIG. 3 pallet, the sanitizing procedure contemplates an adhesive or glue deposit 82 in the clearance 80. Another adhesive or glue deposit 84 is made at the corner junctions 86 of the cover sides 66, to close off the openings 60 into the interior of the FIG. 3 pallet.

The pallet 34A, 34B with its cooperating cover 62 in assembled relation as just described is thus in a completely sealed condition against insect infestation through the flute openings 60, and the components, such as the plies 26 and 28 of the pallet 10, and of the cover panel 68 and sides 66 being of kraft paper construction have the necessary physical and chemical attributes to withstand insects "eating" by ingesting the construction material to gain access into the interior of the pallet 10.

The covered pallet 10 is then utilized in the same manner as is the unsanitized version, previously described and illustrated in FIGS. 5, 6, 7A and 7B.

While the sanitized cardboard pallet, herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A combination of pallet and cover, said pallet of kraft paper construction material comprising a cooperating rectangular pair of an upper pallet half and a lower pallet half joined at confronting edges by a fold line, an assembly of said pallet halves folded about said fold line into superposed relation to each other, said assembly having a specified height, a pair of kraft paper panels in clearance positions from each other in each said pallet half, an undulating flute configuration disposed in each pallet half clearance and having edges bounding access openings into interiors of said pallet halves, edges in one said pallet half kraft paper panel bounding at least three rows of three circular leg-receiving openings, plural circular leg supports in a number corresponding to said number of said leg-receiving openings, cooperating first and second adhesives separately applied to said leg-receiving openings and to an end of said leg supports effective to establish an adhesive attachment therebetween upon contact of said first and second adhesives with each other, and a kraft paper-constructed cover having an operative position disposed in covering relation over said assembled pallet halves, said cover comprising a rectangular top panel having four peripheral edges, a pair of cooperating first and second fold lines spaced inwardly of each peripheral edge deliminating an interior cover side between said peripheral edge and said first fold line and deliminating an exterior cover side between said first fold line and said second fold line, each said interior cover side having an operative position folded about said first fold line into contact rearwardly against said exterior cover side, each said adjacent interior and exterior cover sides having an operative position folded about said second fold line in perpendicular relation to said top panel so as to position a said peripheral edge to the interior of said cover and a said first fold line to the exterior of said cover, said cover exterior and interior sides bounding a pallet-receiving compartment of a height similar to said height of said assembly, said assembly having an operative position disposed to a full extent of its height into said pallet-receiving compartment so as to seal off said access openings into said interiors of said pallet halves, whereby said sealed of access openings obviate insect infestation of said pallet.

* * * * *